United States Patent [19]

Hüppi

[11] 4,115,083

[45] Sep. 19, 1978

[54] ELECTRODE HANGER

[75] Inventor: Xaver Johann Hüppi, Zurich, Switzerland

[73] Assignee: Elex A.G., Zurich, Switzerland

[21] Appl. No.: 802,264

[22] Filed: May 31, 1977

[51] Int. Cl.[2] ..... B03C 3/40

[52] U.S. Cl. ..... 55/148

[58] Field of Search ..... 55/140, 141, 147, 148–152; 339/256 R, 258 R

[56] References Cited

U.S. PATENT DOCUMENTS

| | | | |
|---|---|---|---|
| 1,035,422 | 8/1912 | Cottrell et al. | 55/152 |
| 3,483,670 | 12/1969 | Quintilian et al. | 55/148 |
| 3,686,829 | 8/1972 | Stocker | 55/149 |
| 3,835,623 | 9/1974 | Kline | 55/148 |

FOREIGN PATENT DOCUMENTS

| | | | |
|---|---|---|---|
| 401,997 | 7/1967 | Australia | 55/152 |
| 449,715 | 7/1948 | Canada | 55/150 |
| 503,495 | 7/1930 | Fed. Rep. of Germany | 55/151 |
| 1,158,044 | 11/1963 | Fed. Rep. of Germany | 55/150 |

*Primary Examiner*—Frank W. Lutter
*Assistant Examiner*—David L. Lacey

[57] ABSTRACT

An electrode hanger of unitary construction for an electrostatic precipitator having means on the upper end thereof for engaging with a current carrying support means and means on the lower end thereof for receiving an electrode thereon.

3 Claims, 2 Drawing Figures

ELECTRODE HANGER

BACKGROUND OF THE INVENTION

1. Field of the Invention

This invention relates to an electrode hanger for electrostatic precipitators and more particularly relates to an electrode hanger for an electrostatic precipitator with means to receive an electrode thereon.

2. Description of the Prior Art

Electrostatic precipitators are well known in the art for use in the removal of particulates in a dirty gas stream. These precipitators are provided with high tenstion electrodes which have portions of their surfaces designed to facilitate corona discharge therefrom. The corona discharge produces an ionizing electric field through which particles of suspended matter in a flowing gas stream become electrically charged. These high tension electrodes, otherwise known as discharge electrodes, are opposed by other electrodes which are grounded and designed to eliminate the formation of corona discharge at their surfaces. These grounded electrodes, otherwise known as collecting electrodes, attract the ionized particles in the flowing gas stream and collect these particles on the surfaces thereof.

In most precipitators for industrial applications, the discharge electrodes are arranged vertically and attached at their upper ends to hangers which are in electrical communiation with a current carrying support means. In one preferred support means for discharge electrodes, the current carrying support means is provided with tabs projecting therefrom for removably engaging electrode hangers thereon. One such removably engaging hanger is described in U.S. Pat. No. 3,835,623. However this type of hanger is a substantially flat member and other means have to be added thereto before the hanger is capable of receiving a discharge electrode thereon.

SUMMARY OF THE INVENTION

In the present invention,, it is recongized that it is desirable to provide an improved electrode assembly for detachably mounting to a current carrying support means. Furthermore, it is recognized that it is desirable to provide an electrode hanger for an electrostatic precipitator which is of unitary construction.

The present invention advantageously provides a straightforward arrangement for an electrode hanger of unitary construction for an electrostatic precipitator with means at one end thereof for detachably engaging with a current carrying support means and on the other end thereof receives a discharge electrode thereon. The present invention further provides an electrode hanger that is inexpensive, sturdy, and easy and quickly operable for detachable engagement with a current carrying support means.

Various other features of the present invention will become obvious to those skilled in the art upon reading the disclosure set forth hereinafter.

More particularly, the present invention provides an electrode hanger of unitary construction for an electrostatic precipitator comprising: a member having an upper end with means thereon engageable with a current carrying support means; and, the member having a lower end with outwardly extending wing portions turned to form a receiving portion for an electrode thereon.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
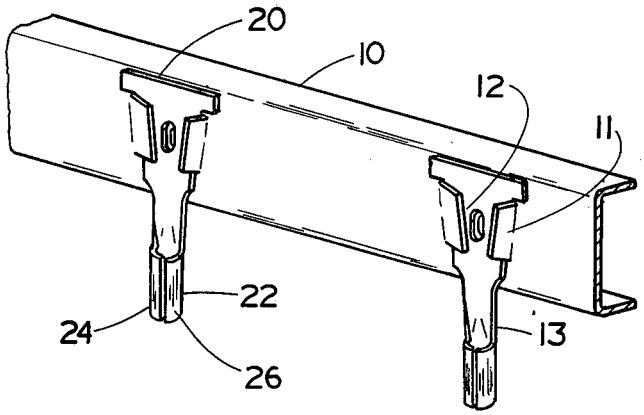
FIG. 1 is a perspective view of an electrode hanger of the present invention mounted onto a current carrying support member; and, FIG. 2 is an enlarged perspective view of the electrode hanger of FIG. 1 receiving a discharge electrode thereon.
Figure 2:
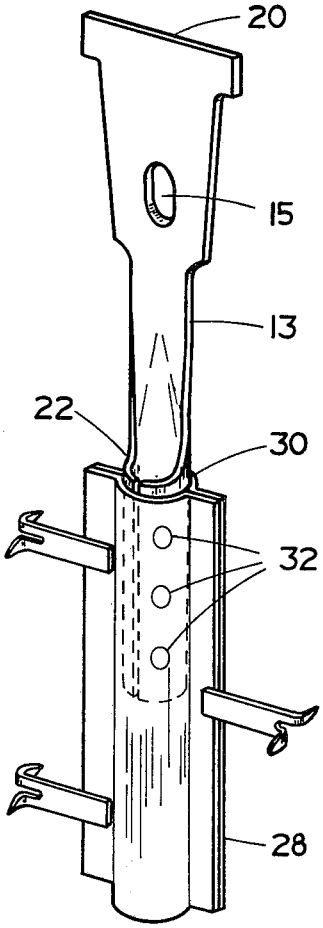

In FIG. 1 a current carrying support member 10 includes a plurality of preselectively positioned sets of hanger engaging tabs 11 projecting therefrom. The tabs 11 are oblique with respect to each other and lie in intersecting planes projecting from the same side of support member 10. Each tab 11 is punched from the support member 10 and forms, in cross-section a V-shaped electrode hanger receiving slot 12, the tabs 11 projecting outwardly at an angle of about 30° with respect to support member 10. Each electrode hanger receiving slot 12 removably receives an electrode hanger 13 therein. It is realized that in FIG. 1 electrode receiving slot 12 is V-shaped in cross-section, but can be configured to other shapes to receive electrode hangers of other configurations than the one shown and described.

Electrode hanger 13 is shaped at its upper end 20 to engage tabs 11 and be in positive electrical contact between tabs 11 and support member 10. The electrode hanger 13 is advantageously flat at its upper end 20 but the end 20 can be of any curvature which is cooperatively adaptable for being received by the tabs 11.

The lower end 22 of the hanger 13 includes outwardly extending wing portions 24 and 26 which are curved so the edges of the wing portions 24 and 26 are juxtaposed, the curved lower end 22 being circular in shape to be inserted into the upper corresponding hollow end 30 of an elongated discharge electrode 28. It is realized that the curvature of the lower end 22 may take on other configurations, the configuration of the lower end being adapted for mating relation with the upper end 30 of a discharge electrode 28. Generally, the upper end 30 slips over the lower end 22 and is spot welded as at 32 thereto.

The electrode hanger 13 is also provided with an aperture 15 therein, aperture 15 being provided to align with a corresponding aperture (not shown) in support member 10 to allow a fastener, such as a nut and bolt (not shown) to be passed therethrough.

It is realized that various changes may be made to the specific embodiment shown and described without departing from the principles of the present invention.

What is claimed is:

1. An electrode hanger and discharge electrode assembly for an electrostatic precipitator having a current carrying support member, comprising:

(a) an elongated discharge electrode having one end formed with a hollow portion; and, (b) a unitary electrode hanger having an upper end with means thereon engageable with the current carrying support member and a lower end with generally outwardly extending wing portions configured and positioned in mating relationship into said hollow end portion of said discharge electrode.

2. The assembly of claim 1 wherein said wing portion of said lower end are juxtaposed.

3. The assembly of claim 1, wherein said lower end has a circular cross-section.

* * * * *